US005303766A

United States Patent [19]

Kreijger et al.

[11] Patent Number: 5,303,766

[45] Date of Patent: Apr. 19, 1994

[54] APPARATUS AND METHOD FOR THE MANUFACTURE OF HOT-ROLLED STEEL

[75] Inventors: Pieter J. Kreijger, Castricum; Rein L. Huisman; Robert F. Gadellaa, both of Beverwijk; Frans Hollander; Leo A. Kuhry, both of Castricum, all of Netherlands

[73] Assignee: Hoogovens Groep B.V., Ijmuiden, Netherlands

[21] Appl. No.: 851,396

[22] Filed: Mar. 16, 1992

[30] Foreign Application Priority Data

Mar. 22, 1991 [EP] European Pat. Off. ..... 91200691.3
May 28, 1991 [NL] Netherlands ..... 9100911

[51] Int. Cl.[5] ..... B22D 11/12; B21B 1/46

[52] U.S. Cl. ..... 164/476; 29/33 C; 29/527.7; 164/417

[58] Field of Search ..... 164/476, 417; 29/33 C, 29/527.7

[56] References Cited

U.S. PATENT DOCUMENTS

| | | | |
|---|---|---|---|
| 3,491,823 | 1/1970 | Tarmann et al. | 164/476 |
| 3,746,076 | 7/1973 | Baumann . | |
| 4,817,703 | 4/1989 | Rohde et al. | 164/417 X |
| 4,846,254 | 7/1989 | Kimura | 164/426 |
| 4,951,734 | 8/1990 | Hoffken et al. | 164/417 X |
| 4,955,428 | 9/1990 | Schrewe | 164/417 |
| 4,958,677 | 9/1990 | Kimura | 164/476 X |
| 4,986,341 | 1/1991 | Masuda et al. . | |
| 5,042,563 | 8/1991 | Jolivet et al. | 164/476 |

FOREIGN PATENT DOCUMENTS

| | | | |
|---|---|---|---|
| 3714432 | 11/1988 | Fed. Rep. of Germany . | |
| 55-50912 | 4/1980 | Japan | 29/527.7 |
| 61-222611 | 10/1986 | Japan | 29/527.7 |
| WO89/11363 | 11/1989 | PCT Int'l Appl. . | |

OTHER PUBLICATIONS

Rowe, G. W. "Principles of Industrial Metalworking Processes" 1977, p. 219.

*Primary Examiner*—J. Reed Batten, Jr.
*Attorney, Agent, or Firm*—Stevens, Davis, Miller & Mosher

[57] ABSTRACT

In the manufacture of hot-rolled steel strip, a continuous casting machine casts a slab and a roll stand for reducing the thickness of the slab to make strip is incorporated in line with the continuous casting machine. Advantages of simplicity and rolling quality are obtained when the roll stand is a two-high roll stand having a single pair of rolls. Where there is a reheater for reheating the strip after its rolling in the two-high roll-stand, the two-high roll stand is the sole apparatus for reducing the thickness of the slab after full solidification of the slab and prior to entry of the strip into the reheater.

25 Claims, 5 Drawing Sheets

APPARATUS AND METHOD FOR THE MANUFACTURE OF HOT-ROLLED STEEL

BACKGROUND OF THE INVENTION

1. Field of the Invention

The invention relates to an apparatus for the manufacture of hot-rolled material comprising a continuous casting machine for casting a slab and reduction means in line with the continuous casting machine for reducing the thickness of the slab into a strip. The invention also relates to a method for the manufacture of hot-rolled steel.

2. Description of the Prior Art

An apparatus and method of the type mentioned above are known from the publication DE-OS-3840812. This known apparatus comprises a continuous casting machine for casting thin slabs and reduction means in the form of a four-high stand with four rolls. The continuous casting machine casts a slab with a thickness in the range 50 mm to 100 mm which the reduction means reduce to a thickness of approximately 25 mm. In order to achieve the desired reduction in thickness, it is usual to place several four-high stands directly one after the other. The entry temperature of the slab in the first four-high stand is of the order of 1100° C.

A number of disadvantages are associated with the use of several four-high stands:

- complicated arrangements are required for harmonizing the rolling speed between each of the several mill stands and with the casting speed of the continuous casting machine;
- there is high thermal loading of the work rolls of each four-high stand;
- temperature losses of the workpiece on the several mill stands are relatively high;
- there is high wear and tear on rolls as a result of the number of rolls (several work rolls);
- the long stay time in the rolling unit causes increased oxide layer formation;
- the end-to-end length of the rolling section is large;
- capital investment is high.

SUMMARY OF THE INVENTION

The object of the present invention is to provide an apparatus for manufacturing hot-rolled steel which at least partly avoids or reduces these disadvantages.

In accordance with the invention there is provided apparatus for the manufacture of hot-rolled steel strip, comprising a continuous casting machine for casting a slab and reduction means comprising at least one roll stand for reducing the thickness of said slab to make strip, said reduction means being incorporated in line with said continuous casting machine to perform continuous rolling of said slab, characterized in that said roll stand is a two-high roll stand having a pair of rolls adapted for hot-rolling of said slab into strip.

Preferably the apparatus has reheating means after the two-high roll stand, and the two-high roll-stand is the sole reduction means after full solidification of the slab and before entry of the strip to the reheating means.

Surprisingly it has been found that a single two-high stand produces at least the same metallurgical results as several four-high stands. In addition using a two-high stand can achieve, among other things, the following advantages:

- simple control over rolling speed whereby the entry velocity of 8–0.1 m/min or slower lies adequately within the range of variation of the roll;
- low thermal loading of the work rolls due to their large dimensions;
- temperature losses of the workpiece are less;
- less wear and tear on the rolls;
- the period of exposure of the thin slab to the atmosphere is shorter so that less oxide forms;
- with a single mill stand, it is simpler to remove the oxide on account of the easier accessibility compared with several four-high stands;
- when removing oxide using high-pressure water jets, cooling takes place only once and not several times as is the case with several four-high stands.

Trials on steel grades St 37, St 52 and an IF grade using the apparatus in accordance with the invention showed that it is possible in one single pass to achieve a reduction in thickness of 60 mm to less than 20 mm, wherein surprisingly the strip also displayed a surface free of cracks. It is preferable that the R-H-ratio, i.e. the ratio of the radius of each of the rolls of the two-high roll stand to the thickness of the slab to be reduced, is at least 3, and in particular that the R-H-ratio is at least 6. In practice, with two-high roll stands, at lower R-H-values than those mentioned here, and for a reduction exceeding, for example, 50% or preferably over 60%, the roll forces on the mill frame become too high, or the work roll bends to such an extent that improper defects of shape occur.

It should be noted that a maximum is imposed on the R-H-ratio on account of mill technology considerations. Accordingly for ingot rolling a maximum R-H-ratio of approximately 115 applies, for hot-rolling approximately 135, and for cold-rolling values varying from 400 to 2100. At greater R-H-ratios the rolling process becomes unstable as a result of the displacement of the neutral line. It is then not certain that the steel to be rolled will feed through the roll gap. Moreover, such a high degree of deformation of the rolls then occurs that the rolled product has unacceptable defects of shape.

Known rolling processes are carried out with an apparatus wherein the R-H-ratio lies close to those upper limits. It has been found that the advantages mentioned above may also be achieved with much lower R-H-values in the present invention.

A strip which is rolled with the aid of such an apparatus is particularly suited to being subsequently rolled out ferritically into a thin strip with good deformation properties.

Stable feed of the slab to be rolled is obtained when the square root of the ratio of the thickness reduction of the thin slab and the radius of each roll of the two-high roll stand is less than 1.1 times the arc tangent of the coefficient of friction between the slab and the roll, i.e. $\sqrt{(\Delta t/R)} < 1.1 \tan^{-1} f$, where $\Delta t$=amount of thickness reduction, R is roll radius and f the coefficient of friction. This ratio is also called the angle of bite (in units of radians). When this condition is fulfilled, the angle of bite between the roll and the slab becomes so small in relation to the friction that stable feed of the slab is ensured.

It is preferable for the ratio between the radius of each of the rolls of the two-high roll stand and the height of the roll gap to be at least 10. The greater is the radius of the roll relative to the height of the roll gap, the greater is the amount of slip occurring in the roll gap during rolling. Within certain limits, more slip has an advantageous effect on the stability of the rolling process. However, one effect does occur in the roll gap that is known by the name "stick". This is used to indicate that there is a zone in the roll gap in which the peripheral speed of the roll and the velocity of the thin slab are approximately equal. If the stick value is too high this has a disadvantageous effect on the surface quality and on the isotropy of the rolled thin slab. Equally it has been found that, within certain limits, the relative size of the zone where stick occurs increases less rapidly with the height of the roll gap than the slip.

It is further preferable for the radius of each of the rolls to be at least 400 mm. It has been found that, even with large reductions as mentioned previously, within the loading limits of the mill stand, the forces on it then remain unchanged during the rolling of a normal thin slab, and that no unacceptable roll deformation occurs.

The apparatus in accordance with the invention may be provided with means for cast rolling for reducing the slab in thickness before its full solidification, i.e. where its core has not yet solidified. Cast rolling influences the internal structure of the slab and the strip manufactured by it, so that, following ferritic rolling, a structure results which makes the material particularly suitable for formable steel.

Preferably, between the continuous casting machine and the two-high roll stand, a high-pressure liquid jet is placed for removing an oxide layer on the slab, and in particular in that several liquid jets are placed next to each other across the width. These jets may be controlled independently of each other in order to influence the amount of oxide removed locally. This allows the oxide scale formed on the slab to be removed and prevents parts of the oxide scale from being rolled in.

In order to keep the reduction forces low and to achieve a good quality surface, the apparatus is preferably provided with a lubricant feed system for applying a lubricant between the slab and the rolls of the two-high roll stand. This can also produce an improved structure.

As far as capacity is concerned, a good linkage between continuous casting machine and two-high stand is obtained when the rolling speed of the two-high roll stand lies between 0.01 and 30 m/min and preferably between 0.1 and 20 m/min.

In particular, good harmonization of the throughput of the continuous casting machine with the throughput of the two-high roll stand can achieve an extra advantage, when processing means are placed after the two-high roll stand for rolling the strip ferritically. This apparatus is suited to continuous processing in the manufacture of formable steel with cold strip properties.

The invention also provides a method for the manufacture of steel strip comprising the steps of continuously casting steel into slab in a continuous casting machine and effecting reduction of said slab into strip by hot-rolling at least in the austenitic region, characterized in that hot-rolling reduction of the slab takes place in a single pass through a two-high roll stand 4 having a pair of rolls adapted to effect reduction of the slab into strip.

Preferably said two-high roll stand is arranged in line with said continuous casting machine for continuous rolling of said slab, and said single pass through said two-high roll stand is the sole reduction of said slab after full solidification thereof and before reheating of the strip in a reheating means.

This method can produce a strip with properties which are at least equivalent to the properties obtained with the known method, while the thermal loss during rolling is less than with the method known from DE-OS-3840812.

A particular advantage is achieved when the slab is reduced by at least 50% in thickness in the two-high roll stand and more especially in that the thin slab is reduced by at least 60% in thickness. The reduction percentage is the thickness reduction relative to the input thickness of the thin slab. With a conventional continuous casting machine, at these reductions a strip is obtained with a thickness of approximately 20 mm.

With an exit thickness of the strip from the two-high roll stand of approximately 20 mm, this strip is simple and quick to homogenize and is especially suited to being rolled ferritically into formable steel.

Preferably the thin slab is rolled under operational conditions in which the slip coefficient increases as the degree of reduction increases. Here the slip coefficient is taken to be the relative difference in velocity between the exiting strip and the periphery of the roll compared with the peripheral velocity of the roll. Depending on rolling parameters including the coefficient of friction, there is a range in which the slip coefficient increases as the degree of reduction increases. For the sake of the stability of the rolling process it is an advantage to work within that range.

For the sake of the stability of the rolling process it is furthermore an advantage if the thin slab is rolled under operational conditions in which the rolling force increases as the degree of reduction increases.

Research has shown that, dependent on the coefficient of friction, the slip coefficient and the rolling force increase, remain constant or decrease as the degree of reduction increases. For the sake of controllability of the rolling process it is desirable to select the rolling parameters so that the rolling takes place under the operational conditions defined above.

Depending on the metallurgical composition of the thin slab, the oxide on its surface influences the lubricating action. This is particularly the case with low carbon steel grades containing titanium.

For the sake of controllability of the rolling forces occurring, it is further desirable for the slab thickness to be smaller than 100 mm.

The internal structure of the strip and the surface of the strip are further improved if the two-high stand lubricates during rolling.

The structure of the strip produced is particularly suited to subsequent ferritic rolling, especially when the slab is cast rolled with its core still molten.

BRIEF INTRODUCTION OF THE DRAWINGS

The invention will be illustrated in the following with reference to the accompanying drawings of a non-limitative example. In the drawings:

FIG. 1 is a schematic representation of an apparatus embodying the invention, FIG. 2*a* is a graphical representation of the temperature gradient of a point of the thin slab as a function of the time in the case of a typical prior art process, and FIG. 2*b* in the case of a method in accordance with the invention, FIG. 3 is a graphical representation of the relationship between angle of bite and roll diameter, FIG. 4 is a graphical representation of the rolling force as a function of the roll diameter, FIG. 5 shows the trend of the rolling force as a function of the exit thickness of the rolled thin slab, FIG. 6 shows the trend of the slip coefficient and the stick percentage as a function of the exit thickness of the rolled thin slab, FIG. 7 shows the relationship between the slip coefficient and the exit thickness for different values of coefficient of friction, FIG. 8 shows the relationship between the specific rolling force and the exit thickness for different values of coefficient of friction.

DESCRIPTION OF THE PREFERRED EMBODIMENTS

Figure 1:
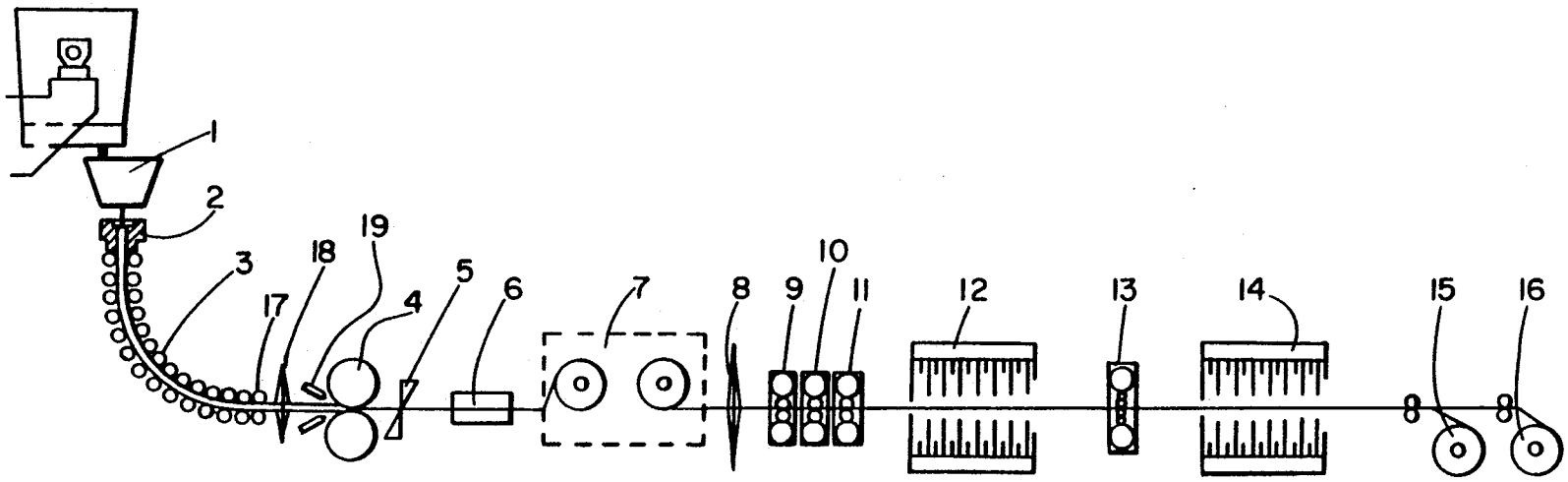

FIG. 1 shows the tundish 1 of a continuous casting machine for casting thin slabs. The liquid steel from the tundish flows into the mould 2. The slab leaving the mould has a thickness of for example 60 mm at an exit velocity of 5 m/min. In the roller track 3 there is an apparatus 17 for cast rolling of the not fully solidified slab (this is known as squeezing while solidifying). The slab thus leaves the roller track 3 with a thickness of 45 mm and at a velocity of 6.6 m/min and a temperature of approximately 1100° C. This slab enters the two-high roll stand 4 for which, for example, blooming rolls from a blooming mill may be used. The strip exiting from the two-high roll stand 4 has a thickness of approximately 15 mm at an exit velocity of approximately 20 m/min and a temperature of approximately 1050° C. Placed before the two-high roll stand 4 there may be a high pressure jet system 18 for removing oxide scale from the slab and a feed system 19 for a lubricant.

If desired, shears 5 may be used to cut off the head and tail of the strip rolled by the roll stand 4. If necessary the strip may be heated up to approximately 1120° C. in an induction furnace 6 direct coupled to the stand 4 for continuous processing of the strip. If an induction furnace is indeed necessary, then it may be smaller than in the current state of the art because the temperature drop of the thin slab is less in the apparatus of this embodiment. A so-called coil-box 7 may be placed after the induction furnace in order to compensate for any, possibly temporary, throughput discrepancies with the subsequent processing plant. After the coil-box 7 is the start of apparatus for further rolling of the strip. The single pass through the two-high roll stand 4 may be the sole reduction of the fully solidified steel in the austenitic region, or there may be subsequent austenitic reduction before ferritic rolling begins. Ferritic rolling comprises a reduction of the strip in the ferritic temperature range and above 200° C. A scale breaker 8 in the form of a high pressure jet removes oxide. Three four-high stands 9, 10 and 11 reduce the strip from 15 mm at 0.33 m/s and 1020° C. to 1.5 mm at 3.3 m/s and 880° C. The strip is cooled down in cooling installation 12 to the desired temperature range for ferritic rolling in mill stand 13. The exit velocity of mill stand 13 is 7.0 m/s with a strip thickness of 0.7 mm. Following any cooling in a further cooling unit 14 the rolled thin strip is coiled onto one of the reels 15 or 16.

Unless otherwise stated, FIGS. 2*a*, 2*b* and 3-8 throughout to a rolling process in which a thin steel slab is rolled in accordance with the invention in the austenitic temperature range from an entry thickness of 60 mm and a width of 1000 mm to a strip with a finished thickness of 15 mm using a two-high roll stand of which each roll has a radius of 670 mm and in which the exit velocity of the strip is 0.5 m/s.

Figure 2A:
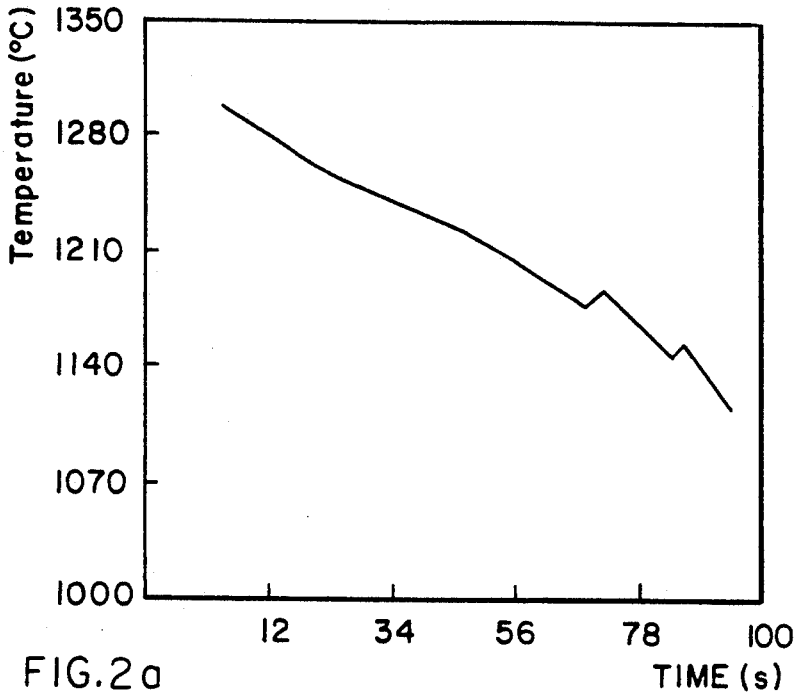
FIG.2a PRIOR ART

FIG. 2*a* shows the temperature gradient of a point of the thin slab as a function of the time in a rolling process in accordance with a typical process in the current state of the art, wherein the thin slab is reduced into strip in three reduction stages. The reduction stages are successively 60-45-25-15 mm, and the radius of each work roll of each four-high stand is 350 mm. The spacing between each of the four-high stands is 5 meters. The horizontal axis in the figure indicates the time in seconds; along the vertical axis is the temperature of a point of the thin slab. The figure shows that in total there is a temperature drop of approximately 190° C.

Figure 2B:
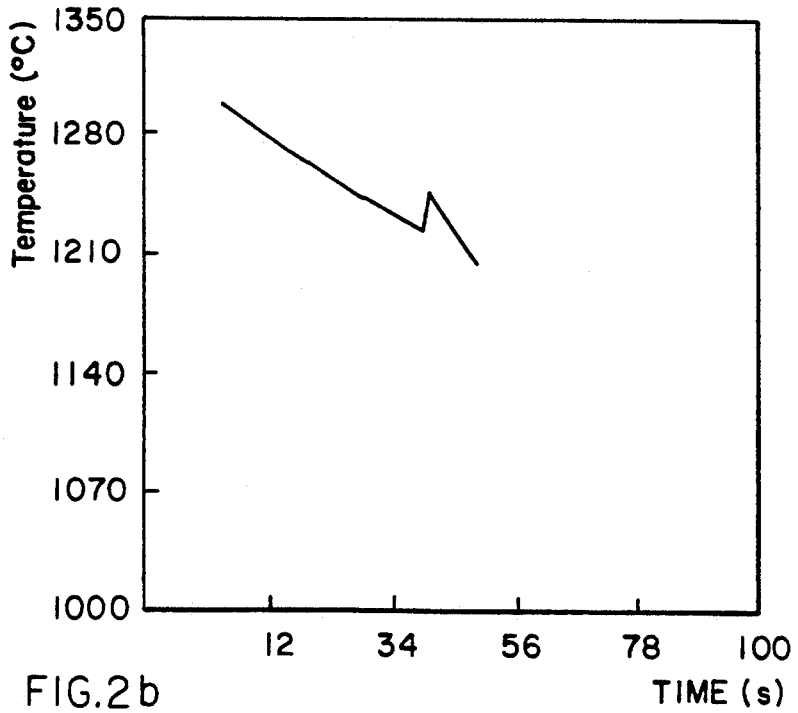

FIG. 2*b* shows the temperature of a point of the thin slab when rolled with a single two-high roll stand in accordance with this invention. This figure shows that the temperature drop is now only approximately 90° C. Moreover, comparing the two diagrams in FIGS. 2*a* and 2*b* shows that with the apparatus in accordance with current state of the art the rolling process lasts approximately 92 s and with the apparatus in accordance with the invention just 45 s. Consequently this also substantially decreases the time in which oxide formation can occur.

Figure 3:
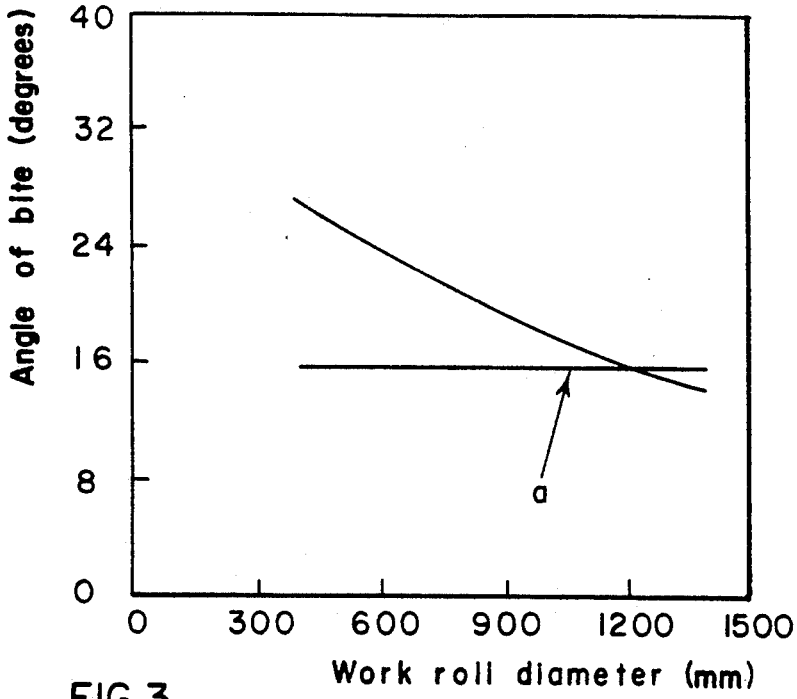

FIG. 3 shows the relationship between angle of bite (vertical axis) an roll diameter (horizontal axis). Here the angle of bite is given in degrees. The angle of bite (in radians) is defined as the square root of the ratio between the thickness reduction during rolling and the radius of the roll. The horizontal line a in the figure also indicates the arc tangent of the coefficient of friction, set here at 0.27.

FIG. 3 shows that for a radius of the roll greater than 620 mm the angle of bite is smaller than the arc tangent of the coefficient of friction so that stable input of the thin slab into the two-high roll stand is achieved.

Figure 4:
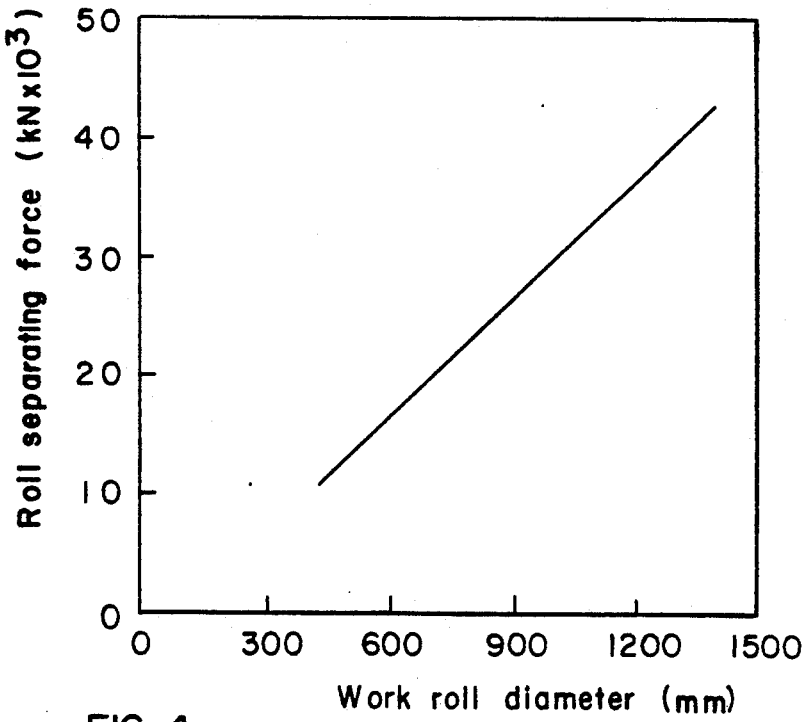

FIG. 4 plots the rolling force during rolling expressed in MN against the radius of the roll at a coefficient of friction of 0.27. This figure shows that the rolling force during rolling of a roll with a radius of over 620 mm will exceed 37 MN.

Figure 5:
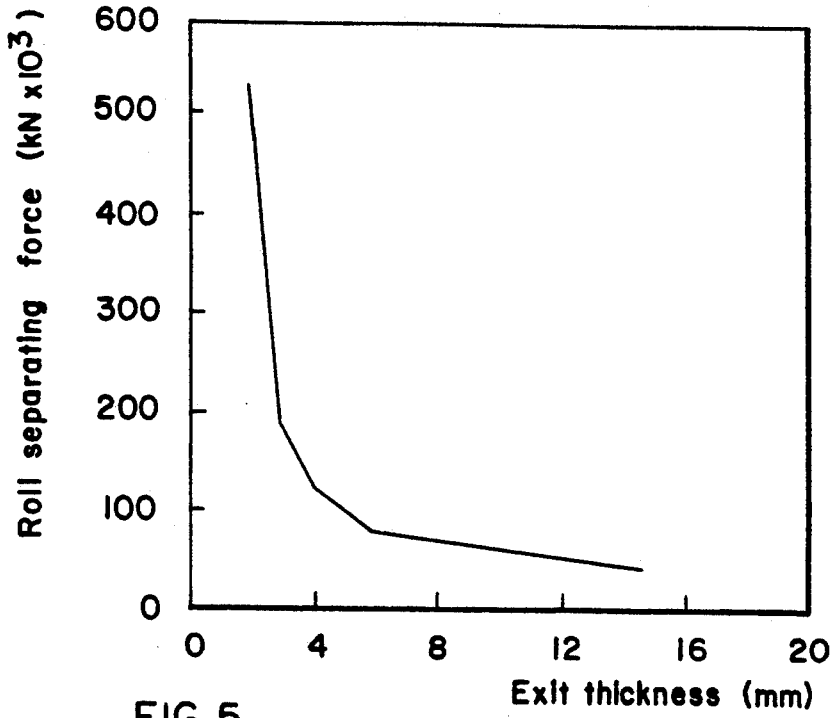

FIG. 5 shows the trend of the rolling force expressed in MN as a function of the exit thickness of the thin slab rolled into strip with an entry thickness of 60 mm. The figure shows that under these conditions the rolling forces remain within the limits of two-high stands available in practice up to an exit thickness of approximately 6 mm. For smaller exit thicknesses the rolling force increases rapidly.

Figure 6:
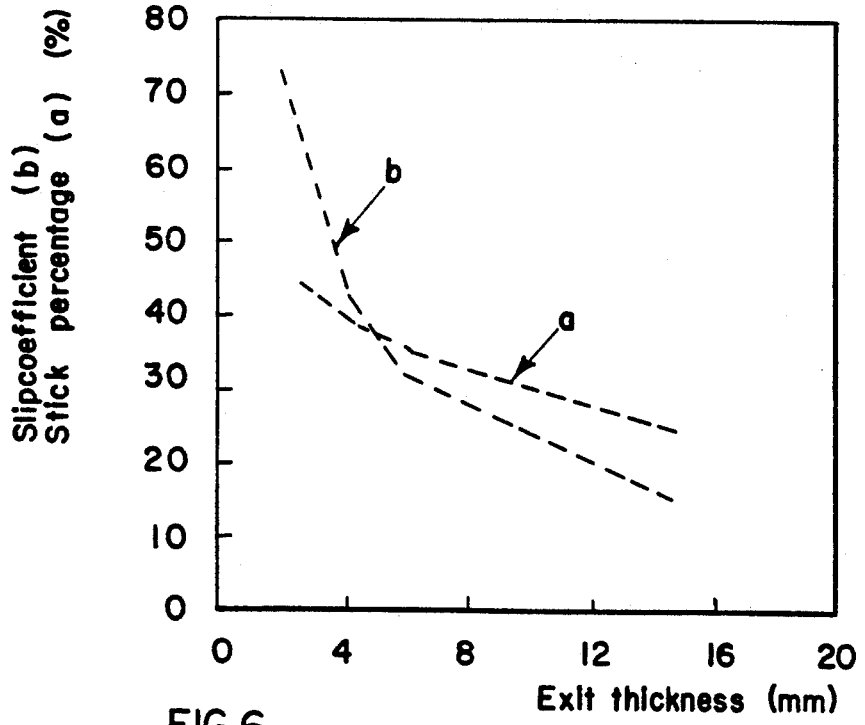

FIG. 6 shows the relationship between the stick percentage and the exit thickness of the thin slab rolled into strip curve a. Here "stick" is taken to be the occurrence of a zone on the surface of the thin slab in the roll gap that has the same velocity as the periphery of the roll. The stick percentage is the component of the arc of contact at the roll gap in which stick occurs expressed in percent.

Stick has a negative effect o the rolled material properties. In the case of small reductions, for example with an exit thickness of over 35 mm at a coefficient of friction of 0.27, no stick occurs. When stick does occur, plastic deformation takes place through shear. This shear can have a negative effect on the quality of the surface. Furthermore, this kind of deformation means that, taken over the thickness, the plastic deformation is not everywhere the same. This proceeds from pure shear to pure normal deformation of the material, depending on the magnitude of the stresses. The r-value of the steel is negatively affected by high stresses. Curve a moves upwards as the coefficient of friction increases.

FIG. 6 also gives the relationship between the slip coefficient (curve b) and the exit thickness. Here the slip coefficient is defined as the ratio of the difference between the velocity of the exiting strip and the periphery of the roll expressed as a percentage of the roll peripheral velocity. According to FIG. 6 the slip coefficient, illustrated here for a coefficient of friction of 0.27, increases as the exit thickness reduces, and thus also with increasing degree of reduction of the slab. Curve b ends at the top at a maximum value determined by the maximum admissible deformation of the roll. For increasing coefficients of friction curve b moves towards the top right.

Figure 7:
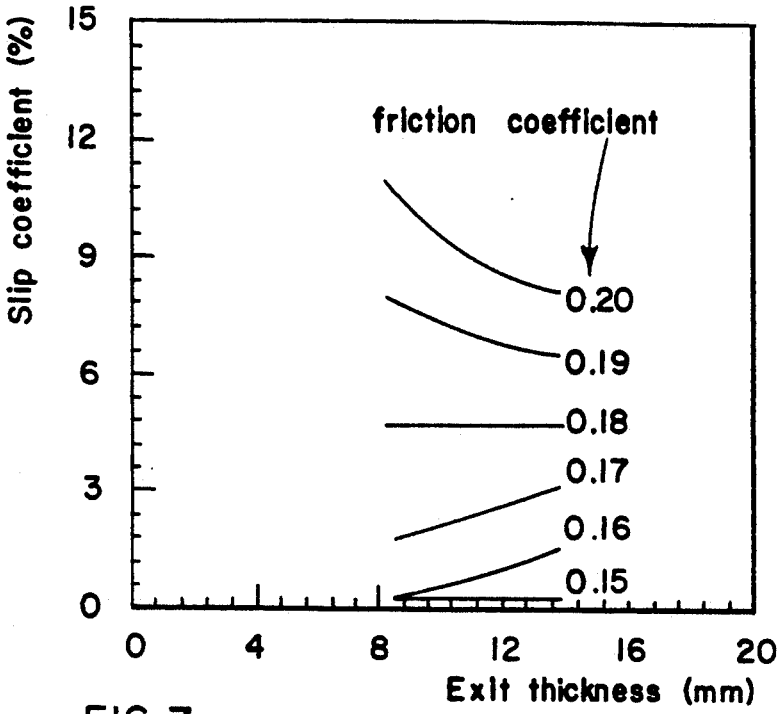
Figure 8:
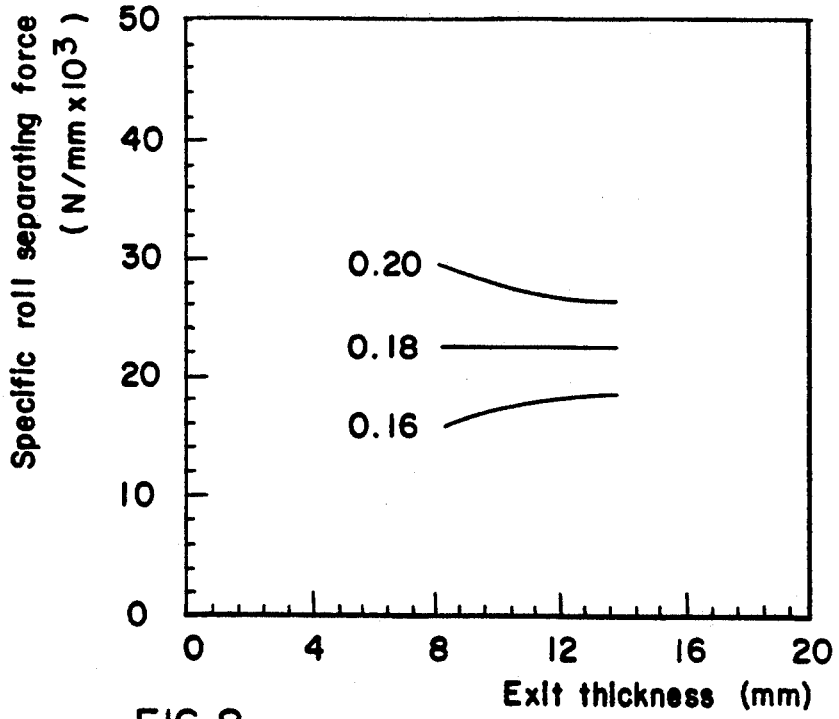

Surprisingly it has been found that when using a two-high roll stand for reducing a thin steel slab, conditions exist wherein the slip coefficient increases with increasing reduction. In a rolling process this is only the case under precisely selected conditions. FIGS. 7 and 8 serve by way of explanation.

FIG. 7 shows the relationship between slip coefficient and exit thickness, for various values of coefficient of friction and a radius of the roll of 620 mm.

The series of curves shows that, under the given conditions, for a coefficient of friction of 0.18 the slip coefficient is independent of the reduction. For higher coefficient of friction values the slip coefficient increases with increasing reduction. In the latter case the slip coefficient can be a limiting factor on the magnitude of the reduction. For a stable rolling process, this factor should not become zero and must preferably be considerably higher. The situation of low friction can occur where in the case of ferritic rolling the friction has to be kept low by lubrication.

FIG. 8 shows the trend of the specific rolling force as a function of the exit thickness in the case of three different values of coefficient of friction. Here too, at a coefficient of friction of 0.18 a change of behaviour has been found to occur. At a higher coefficient of friction than 0.18, the rolling force increases as degree of reduction increases. In the opposite situation, large reductions may cause instability in the rolling process.

What is claimed is:

1. Apparatus for the manufacture of hot-rolled steel strip, comprising a continuous casting machine for casting steel slab, reduction means comprising a two-high roll stand having a pair of rolls adapted for hot-rolling of said slab into strip, said two-high roll stand being incorporated in continuous line with said continuous casting machine to perform continuous rolling of said slab and reheating means for reheating of said strip after its rolling in said two-high roll-stand, said two-high roll stand being the sole means for reducing the thickness of said slab after full solidification of the slab and prior to entry of the strip into said reheating means.

2. Apparatus for the manufacture of hot-rolled steel strip, comprising a continuous casting machine for casting steel slab and reduction means comprising a two-high roll stand having a pair of rolls adapted for hot-rolling of said slab into strip, said two-high roll stand being incorporated in continuous line with said continuous casting machine to perform continuous rolling of said slab and a ratio of the radius of each of said rolls of said two-high roll stand to the thickness of the slab before reduction by said rolls (R-H-ratio) is at least 3.

3. Apparatus according to claim 2 wherein said R-H-ratio is at least 6.

4. Apparatus for the manufacture of hot-rolled steel strip, comprising a continuous casting machine for casting steel slab and reduction means comprising a two-high roll stand having a pair of rolls adapted for hot-rolling of said slab into strip, said two-high roll stand being incorporated in continuous line with said continuous casting machine to perform continuous rolling of said slab and the square root of a ratio of the thickness reduction of the thin slab and the radius of each said roll of said two-high roll stand is less than 1.1 times the arc tangent of the coefficient of friction between the slab and the roll.

5. Apparatus for the manufacture of hot-rolled steel strip, comprising a continuous casting machine for casting steel slab and reduction means comprising a two-high roll stand having a pair of rolls adapted for hot-rolling of said slab into strip, said two-high roll stand being incorporated in continuous line with said continuous casting machine to perform continuous rolling of said slab and a ratio between the radius of each of said rolls of said two-high roll stand and the height of the roll gap of said two-high roll stand is at least 10.

6. Apparatus for the manufacture of hot-rolled steel strip, comprising a continuous casting machine for casting steel slab and reduction means comprising a two-high roll stand having a pair of rolls adapted for hot-rolling of said slab into strip, said two-high roll stand being incorporated in continuous line with said continuous casting machine to perform continuous rolling of said slab and a radius of each said roll of said two-high roll stand is at least 400 mm.

7. Apparatus for the manufacture of hot-rolled steel strip, comprising a continuous casting machine for casting steel slab, reduction means comprising a two-high roll stand having a pair of rolls adapted for hot-rolling of said slab into strip, said two-high roll stand being incorporated in continuous line with said continuous casting machine to perform continuous rolling of said slab and means for reducing the thickness of the slab before complete solidification of the slab and before said hot-rolling in said two-high roll stand.

8. Apparatus for the manufacture of hot-rolled steel strip, comprising a continuous casting machine for casting steel slab, reduction means comprising a two-high roll stand having a pair of rolls adapted for hot-rolling of said slab into strip, said two-high roll stand being incorporated in continuous line with said continuous casting machine to perform continuous rolling of said slab and a high-pressure liquid jet means for removing an oxide layer on the slab between said continuous casting machine and said two-high roll stand.

9. Apparatus according to claim 8 wherein said jet means has a plurality of liquid jets arranged next to each other across the width of the slab, which jets are controllable independently of each other in order to influence the amount of oxide removed locally.

10. Apparatus for the manufacture of hot-rolled steel strip, comprising a continuous casting machine for casting steel slab, reduction means comprising a two-high roll stand having a pair of rolls adapted for hot-rolling of said slab into strip, said two-high roll stand being incorporated in continuous line with said continuous casting machine to perform continuous rolling of said slab and a lubricant feed system for applying a lubricant between the slab and said rolls of said two-high roll stand.

11. Apparatus for the manufacture of hot-rolled steel strip, comprising a continuous casting machine for casting steel slab, reduction means comprising a two-high roll stand having a pair of rolls adapted for hot-rolling of said slab into strip, said two-high roll stand being incorporated in continuous line with said continuous casting machine to perform continuous rolling of said slab and means for rolling the strip ferritically arranged after its rolling in said two-high roll stand.

12. Method for the manufacture of steel strip comprising the steps of (a)continuously casting steel into slab in a continuous casting machine and (b) effecting hot-rolling reduction of said slab into strip by hot-rolling at least in the austenitic region, said hot-rolling reduction of the slab in the austenitic region comprising a single pass through a two-high roll stand having a pair of rolls adapted to effect reduction of the slab into strip.

13. Method according to claim 12 including the step (c) of reheating said strip by reheating means after said single pass through said two-high roll stand, and wherein said two-high roll stand is arranged in a continuous line with said continuous casting machine for continuous rolling of said slab, and said single pass through said two-high roll stand is the sole reduction of said slab after full solidification thereof and before said reheating.

14. Method according to claim 13 wherein the rolling speed of said two-high roll stand is in the range 0.1 to 20 m/min.

15. Method according to claim 12 wherein the rolling speed of said two-high roll stand is in the range 0.01 to 30 m/min.

16. Method according to claim 12 wherein the rolling speed of said two-high roll stand is in the range 0.1 to 20 m/min.

17. Method according to claim 12 wherein the slab is reduced by at least 50% in thickness in said hot-rolling reduction in said two-high roll stand.

18. Method according to claim 17 wherein said slab is reduced by at least 60% in thickness in said hot-rolling reduction in said two-high roll stand.

19. Method according to claim 12 wherein said slab is rolled in said two-high roll stand under operational conditions of said roll-stand selected such that the slip coefficient increases as the degree of reduction in said roll-stand increases.

20. Method according to claim 12 wherein said slab is rolled in said roll-stand under operational conditions of said roll-stand selected such that the rolling force increases as the degree of reduction in said roll stand increases.

21. Method according to claim 12 wherein during the reduction in the two-high roll stand the square root of the ratio of the thickness decrease of the thin slab and the radius of each roll of the roll-stand is less than 1.1 times the arc tangent of the coefficient of friction between the slab and the roll.

22. Method according to claim 12 including effecting lubrication in the two-high roll stand during rolling.

23. Method according to claim 12 wherein the slab thickness as cast by said continuous casting machine is less than 100 mm.

24. Method according to claim 12 including reducing the thickness of the slab before its core is fully solidified, prior to said hot-rolling reduction.

25. Method according to claim 12 including rolling the strip in the ferritic region after said hot-rolling reduction in the austenitic region.

* * * * *